US011622655B2

(12) United States Patent
Chen

(10) Patent No.: US 11,622,655 B2
(45) Date of Patent: Apr. 11, 2023

(54) REINFORCED PUNCH-FREE ARCUATE SHOWER CURTAIN ROD

(71) Applicant: YUYAO PRETTY HOME SANITARY WARES CO., LTD., Zhejiang (CN)

(72) Inventor: Jianyong Chen, Yuyao (CN)

(73) Assignee: YUYAO PRETTY HOME SANITARY WARES CO., LTD., Zhejiang (CN)

( * ) Notice: Subject to any disclaimer, the term of this patent is extended or adjusted under 35 U.S.C. 154(b) by 0 days.

(21) Appl. No.: 17/499,754

(22) Filed: Oct. 12, 2021

(65) Prior Publication Data

US 2022/0110490 A1 Apr. 14, 2022

(30) Foreign Application Priority Data

Oct. 13, 2020 (CN) ..... 202022260551.5

(51) Int. Cl.
*A47K 3/38* (2006.01)

(52) U.S. Cl.
CPC ..... *A47K 3/38* (2013.01)

(58) Field of Classification Search
CPC ..... A47K 3/38
USPC ..... 4/610, 605, 612, 607, 557; 49/381
See application file for complete search history.

(56) References Cited

U.S. PATENT DOCUMENTS

| | | | | |
|---|---|---|---|---|
| 4,197,616 | A * | 4/1980 | Panuski | A47K 3/38 160/349.2 |
| 5,345,623 | A * | 9/1994 | Dearman | A47K 3/38 4/558 |
| 7,076,815 | B2 * | 7/2006 | Orpilla | A47K 3/38 4/558 |
| 7,346,940 | B1 * | 3/2008 | Liao | A47K 3/38 4/557 |
| 8,069,507 | B2 * | 12/2011 | Didehvar | A47K 3/38 4/610 |
| 9,578,995 | B2 * | 2/2017 | Hanley | A47H 13/04 |
| 11,026,546 | B1 * | 6/2021 | Broussard | A47K 3/38 |
| 2001/0039677 | A1 * | 11/2001 | Bryce | A47K 3/38 4/609 |
| 2008/0028513 | A1 * | 2/2008 | Didehvar | A47K 3/38 248/265 |
| 2011/0047693 | A1 * | 3/2011 | Bauer | A47K 3/38 4/609 |

(Continued)

FOREIGN PATENT DOCUMENTS

| | | | | |
|---|---|---|---|---|
| CA | 2693316 | A1 * | 3/2011 | A47K 3/38 |
| EP | 1902655 | A1 * | 3/2008 | A47K 3/38 |
| WO | WO-2012072988 | A2 * | 6/2012 | A47K 3/38 |

*Primary Examiner* — Lori L Baker
(74) *Attorney, Agent, or Firm* — Ladas & Parry, LLP

(57) ABSTRACT

A reinforced punch-free arcuate shower curtain rod includes a base, a sleeve, a short tube, an inner tube, an outer tube, and a pressing member. A double-sided adhesive is disposed on a bottom surface of the pressing member. A positioning block is disposed on the pressing member. The base can be maintained in contact with a wall surface by means of the friction force between the PVC gasket and the wall surface and the adhesive force of the double-sided adhesive. In addition, the positioning block of the pressing member is inserted through the base to be pressed against and in contact with a cambered surface of a front end of the sleeve.

10 Claims, 4 Drawing Sheets

(56) References Cited

U.S. PATENT DOCUMENTS

| | | | | |
|---|---|---|---|---|
| 2013/0198949 | A1* | 8/2013 | Hai | A47K 3/38<br>29/428 |
| 2016/0088977 | A1* | 3/2016 | Hanley | A47K 3/38<br>16/87.8 |
| 2021/0282601 | A1* | 9/2021 | Broussard | A47K 3/38 |

* cited by examiner

REINFORCED PUNCH-FREE ARCUATE SHOWER CURTAIN ROD

CROSS-REFERENCE TO RELATED APPLICATION

This disclosure claims priority to Chinese patent application No. 202022260551.5 filed on Oct. 13, 2020, the disclosure of which is incorporated herein by reference in its entirety.

TECHNICAL FIELD

The disclosure relates to a shower curtain rod among products in a shower cubicle, and in particular, to a reinforced punch-free arcuate shower curtain rod.

BACKGROUND

An arcuate shower curtain rod is a rod structure specially designed for separating a larger shower space at the corner of the bathroom, and is usually composed of a base, a sleeve, a short tube, an inner tube, and an outer tube. A front end of the sleeve is radially swingably connected to the base. A PVC gasket is disposed on a bottom surface of the base. During mounting, the base on two ends of the arcuate shower curtain rod is tightly attached to wall surfaces on two sides by using the PVC gasket. Then the short tube is rotated and mated with mutual expansion and contraction of the inner and outer tubes to cause the base to press against the wall surfaces, thereby ensuring that the arcuate shower curtain rod does not fall after being mounted. However, this kind of arcuate shower curtain rod generally cannot ensure the accuracy of the mounting position during the mounting. The positions at which the base is pressed against two ends on the wall surface require to be constantly adjusted by workers. Therefore, the mounting process is very troublesome and laborious. In addition, the friction force for mounting the base and the wall surface is mainly provided by the PVC gasket. That is to say, the base needs to have sufficient pressing force to press against the PVC gasket to the wall surface, so as to stably mount the base to the wall surface. The shower curtain rod is an arcuate rod, and the front end of the sleeve is radially swingably connected to the base. These are designed for fine adjustment of the positions according to the actual situation after the arcuate shower curtain rod is mounted. However, exactly during the fine adjusting process, the pressing force on the base weakens, and the bearing strength decrease. After long-term use, the base is easy to fall from the wall surface, causing accidental injury to the user.

SUMMARY

In order to resolve the technical problem and overcome the defects of the prior art, the disclosure provides a reinforced punch-free arcuate shower curtain rod on which the base is pressed against the wall surface at accurate mounting positions, which is mounted firmly and stably and is simple and labor-saving to mount.

The technical problems of the disclosure are implemented by using the following technical solutions.

A reinforced punch-free arcuate shower curtain rod, including a base, a sleeve, a short tube, an inner tube and an outer tube, where a front end of the sleeve is radially swingably connected to the base, and PVC gasket is disposed on a bottom surface of the base, where the arcuate shower curtain rod further includes a pressing member, a bottom surface of the pressing member is bonded to a wall surface by using a double-sided adhesive, a positioning block is disposed on the pressing member, the base is positioned and assembled on the positioning block together with the PVC gasket on the bottom surface, and the positioning block is inserted through the base to be pressed against and in contact with a cambered surface of the front end of the sleeve.

An outer cambered head is disposed on the front end of the sleeve, and the front end of the sleeve is radially swung relative to the base, so that the outer cambered head is always pressed against and in contact with the positioning block.

A positioning hole for positioning and assembling the positioning block is provided on the base, and the positioning block and the positioning hole are respectively a non-circular block and a non-circular hole.

A groove for matedly mounting the double-sided adhesive is provided on the bottom surface of the pressing member.

A through hole is provided on one PVC gasket, the positioning block is inserted through the through hole to be positioned and assembled in the positioning hole, and the PVC gasket is tightly mounted to the bottom surface of the base.

A front end of the short tube and a rear end of the sleeve are coaxially and rotatably connected, a screw rod coaxially and fixedly mounted, a screw sleeve threadedly sleeved on the screw rod, and a retainer ring disposed on a rear end of the screw rod are disposed in the short tube, a rear end of the inner tube is telescopically sleeved in the outer tube, and a front end of the inner tube extends into a rear end of the short tube to be fixedly connected to the screw sleeve; and the short tube is rotatable forward and backward to drive the screw rod to rotate synchronously, and drives the screw sleeve and the inner tube to simultaneously move axially and telescopically along the screw rod.

A front sleeve for fixed insertion is disposed on the front end of the short tube, a rear sleeve for fixed insertion is disposed on the rear end of the short tube, a front end of the screw rod is matedly inserted into and fixed to the front sleeve, and the front end of the inner tube is inserted through the rear sleeve into the rear end of the short tube.

A non-circular hole formed along an axis is provided in the front sleeve, a non-circular shaft positioned and inserted into the non-circular hole is disposed on the front end of the screw rod, a screw is threaded in the non-circular hole, the screw is connected to the non-circular shaft to fix the front sleeve and the screw rod as a whole.

A ball head is disposed on a front end of the front sleeve, a ring rib is disposed on an outer circumferential surface of the ball head, a ball groove for matedly assembling the ball head is correspondingly provided on the rear end of the sleeve, and a ring groove is provided on an inner circumferential surface of the ball groove; and the ball head is rotatably assembled in the ring groove of the ball groove by using the ring rib, so that the sleeve is coaxially rotatably connected to the short tube.

A fastening groove and a fastening rib for mated assembly are respectively provided on an outer surface of the inner tube and an inner surface of the outer tube.

Compared with the prior art, in the disclosure, the pressing member is mainly creatively added to the arcuate shower curtain rod. A double-sided adhesive is disposed on the bottom surface of the pressing member. A positioning block is disposed on the pressing member. During use, the pressing member may be first accurately pasted on a position of a desired height by using double-sided adhesive, thereby avoiding punching holes on the wall. Then the base is positioned and assembled on the positioning block of the pressing member together with the PVC gasket on the bottom surface. Mounting positions of two ends of the base are predetermined by using the pressing member, thereby avoiding the trouble for incapability of determining the mounting position of the base and the requirement for continuous adjustment after the base is pressed during the mounting of the traditional arcuate shower curtain rod. In addition, the base is in contact with the wall surface by means of the friction force between the PVC gasket and the wall surface and the adhesive force of the double-sided adhesive. Therefore, the mounted base is extremely firm and stable, and can have a higher endurance strength. In addition, the positioning block of the pressing member is inserted through the base to be pressed against and in contact with a cambered surface of a front end of the sleeve. Therefore, even if the front end of the sleeve is radially swung relative to the base for fine adjustment, the front end of the sleeve can be maintained to be in contact with and pressed against the pressing member through the cambered surface, so that the pressing force on the base does not weaken during the fine adjustment, thereby avoiding the injury caused by the accidental fall of the base from the wall surface.

DETAILED DESCRIPTION

The embodiments of the disclosure are described in detail below with reference to the foregoing accompanying drawings.

As shown in FIG. 1 to FIG. 5, 1. Base, 11. Mounting groove, 12. Bolt, 13. Nut, 14. Decorative cover, 15. Positioning hole, 2. Sleeve, 21. Outer cambered head, 22. Ball groove, 23. Ring groove, 3. Short tube, 4. Inner tube, 41. Fastening groove, 5. PVC gasket, 51. Through hole, 52. Counter bore, 6. pressing member, 61. Double-sided adhesive, 62. Positioning block, 63. Groove, 7. Screw rod, 71. Screw sleeve, 72. Non-circular shaft, 73. Screw, 74. Retainer ring, 8. Front sleeve, 81. Non-circular hole, 82. Ball head, 83. Ring rib, 9. Outer tube, 91. Set screw, 92. Fastening rib, 93. Connecting hole, 94. Plug, 10. Rear sleeve.

Figure 1:
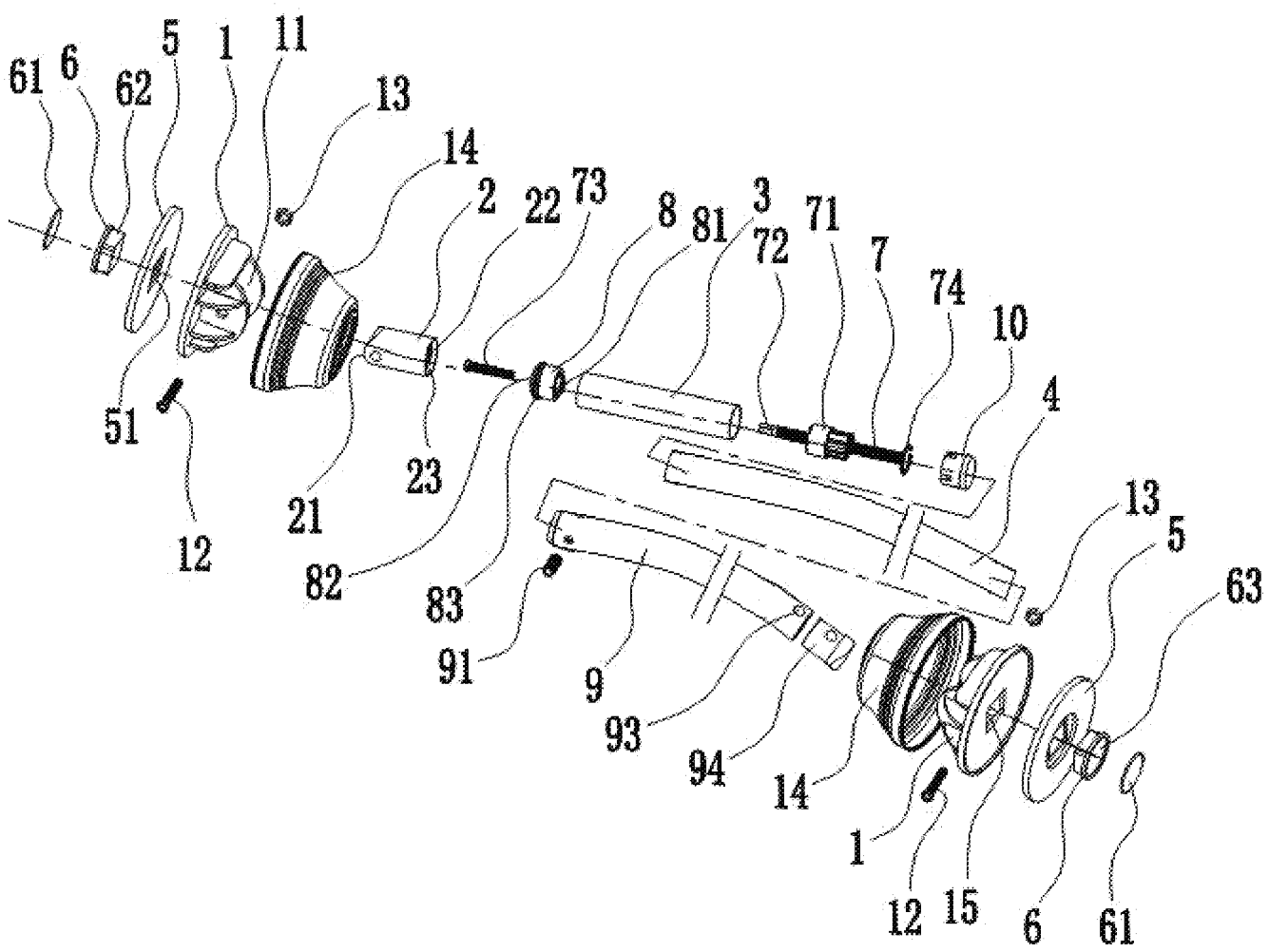
FIG. 1 is a three-dimensional exploded view according to the disclosure.

As shown in FIG. 1, a reinforced punch-free arcuate shower curtain rod mainly relates to a rod structure specially designed for separating a larger shower space at the corner of the bathroom. A structure of the shower curtain rod is mainly composed of a base 1, a sleeve 2, a short tube 3, an inner tube 4, and an outer tube 9.

The base 1 is an important component for tightly pressing against two ends of the shower curtain rod against wall surfaces on two sides. A PVC gasket 5 is disposed on a bottom surface of each base 1. A front end of the sleeve 2 is radially swingably connected to the base 1. The specific structure is as follows. A mounting groove 11 having an axis extending in a radial direction is provided on the base 1. The front end of the sleeve 2 is disposed in the mounting groove 11, and forms reciprocating rotation in the radial direction of the mounting groove 11 after being threaded and tightened by a bolt 12 connected to a nut 13.

A decorative cover 14 is disposed on the base 1, so as to cover the connecting structure between the front end of the sleeve 2 and the base 1, thereby causing the entire base 1 to be aesthetic.

Figure 2:
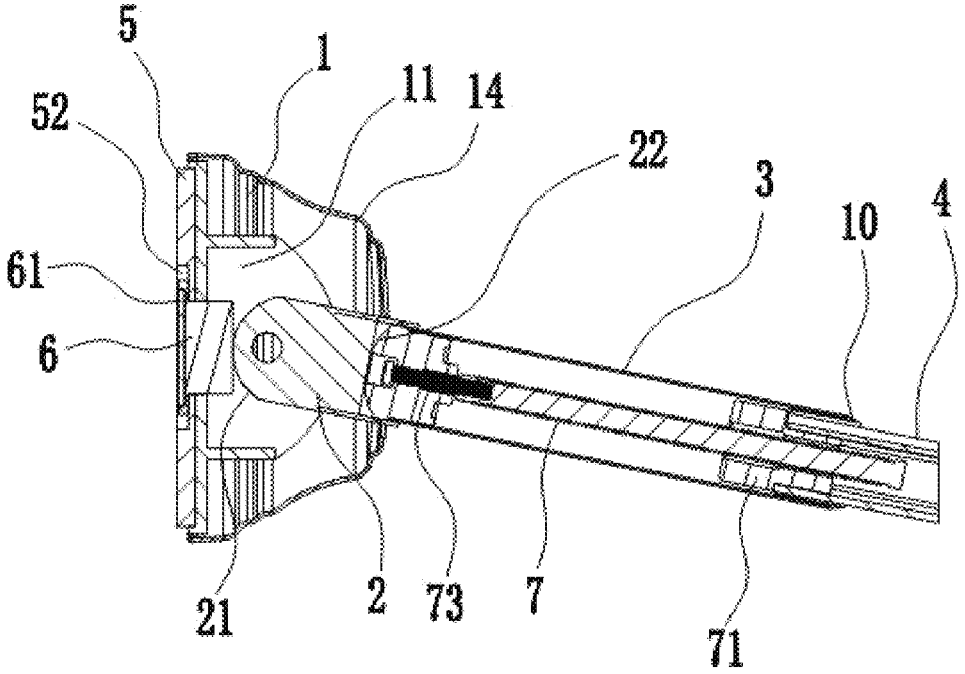
FIG. 2 is a schematic structural sectional view of an inner tube in FIG. 1.
Figure 3:
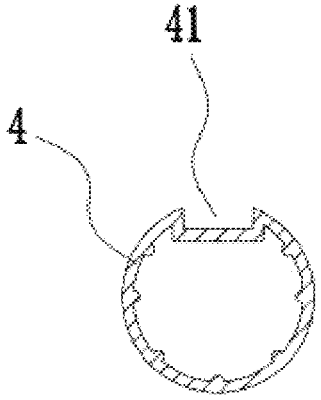
FIG. 3 is a schematic structural cross-sectional view of the inner tube.

A front end of the short tube 3 and a rear end of the sleeve 2 are coaxially rotatably connected. The specific structure is shown in FIG. 2. A front sleeve 8 for fixed insertion is disposed on the front end of short tube 3. The structure for fixed insertion is usually connected as a whole by means of a stamping process. A ball head 82 is disposed on a front end of the front sleeve 8. A ring rib 83 is disposed on an outer circumferential surface of the ball head. A ball groove 22 for matedly assembling the ball head 82 is correspondingly provided on the rear end of the sleeve 2. A ring groove 23 is provided on an inner circumferential surface of the ball groove. In this way, the ball head 82 is rotatably assembled in the ring groove 23 of the ball groove 22 by using the ring rib 83, so that the sleeve 2 is coaxially rotatably connected to the short tube 3.

A screw rod 7, a screw sleeve 71 threadedly sleeved on the screw rod, and a retainer ring 74 disposed on a rear end of the screw rod are disposed in the short tube 3. The retainer ring may be used to prevent the screw sleeve 71 from falling off due to an excessively large thread rotation stroke on the screw rod 7. A non-circular hole 81 formed along the axis is provided in the front sleeve 8. A non-circular shaft 72 is disposed on a front end of the screw rod 7. For example, a rectangular hole and a rectangular shaft are selected in this embodiment. The front end of the screw rod 7 is positioned and matedly inserted into the non-circular hole 81 of the front sleeve 8 by using the non-circular shaft 72, and then a screw 73 is threaded in the non-circular hole and is connected to the non-circular shaft 72, so that the front sleeve 8 and the screw rod 7 are fixed as a whole. That is to say, the screw rod 7 is coaxially fixedly mounted in the short tube 3.

A rear end of the inner tube 4 is telescopically sleeved in the outer tube 9. The inner tube 4 and the outer tube 9 are both arcuate tubes. A set screw 91 for locking, extension, and retraction is disposed on the outer tube 9.

Figure 4:
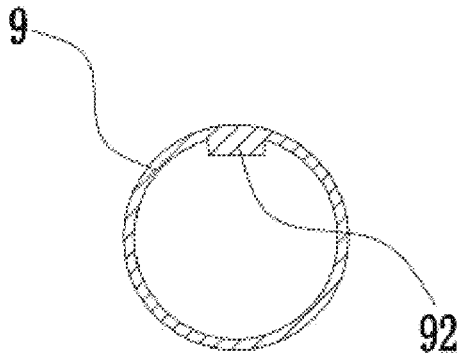
FIG. 4 is a schematic structural cross-sectional view of an outer tube.
Figure 5:
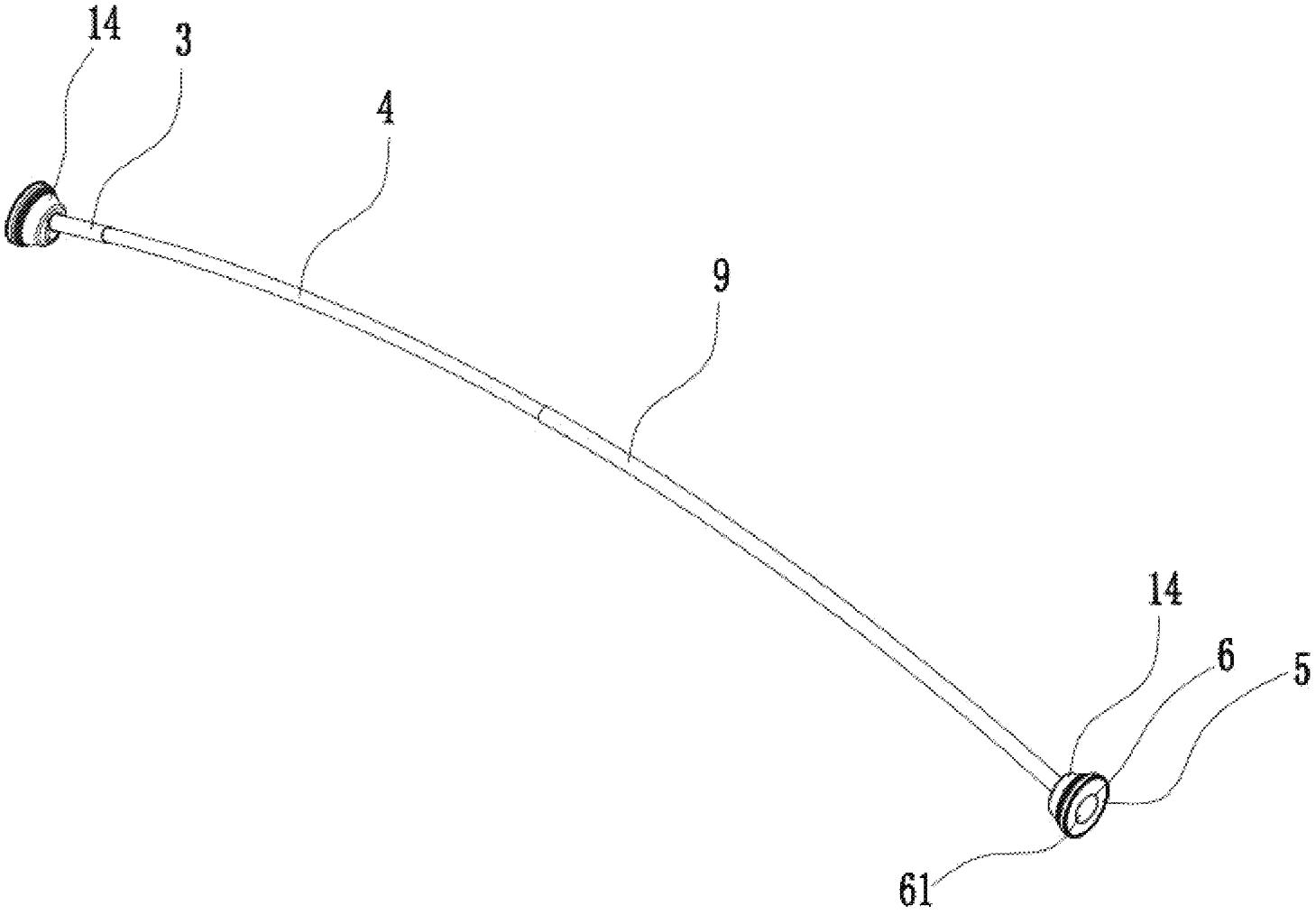
FIG. 5 is an outline drawing of the disclosure.

In addition, a fastening groove 41 and a fastening rib 92 that are matedly assembled are respectively provided on an outer surface of the inner tube 4 and an inner surface of the outer tube 9 shown in FIG. 4 and FIG. 5. The fastening groove 41 is formed by axially extending along the outer surface of the inner tube 4, and the fastening rib 92 is formed by axially extending along the inner surface of the outer tube 9. The design purpose of using the structure is as follows. When the inner tube 4 and the outer tube 9 are tensioned with each other by means of locking, extension, and retraction, an inner wall of the fastening groove 41 and an outer wall of the fastening bar 92 are squeezed and in close contact with each other. This is to say, the contact friction between the inner tube 4 and the outer tube 9 is increased. Therefore, by means of the dual action of the set screw 91 and the contact friction force, the tensioning force between the arc-shaped inner tube and outer tube is increased, and the bases 1 at two ends of the arcuate shower curtain rod can be firmly attached to the wall surface, thereby enhancing the load-bearing capacity of the arcuate shower curtain rod.

The front end of the inner tube 4 extends into the rear end of the short tube 3 to be fixedly connected to the screw sleeve 71 by means of fixed insertion. A rear sleeve 10 for fixed insertion is disposed on the rear end of the short tube 3. The front end of the inner tube 4 is inserted through the rear sleeve 10 into the rear end of the short tube 3, so as to separate the short tube 3 from the inner tube 4, thereby preventing the inner tube 4 from being scratched during rotation of the short tube 3.

Therefore, when the short tube 3 drives the screw rod 7 to rotate synchronously during rotation forward and backward, the rotation of the screw rod is converted to drive the screw sleeve 71 and the inner tube 4 to simultaneously move axially and telescopically along the screw rod 7. The purpose is to conveniently adjust the pressing force on the base 1 during mounting of the arcuate shower curtain rod.

In addition, the arcuate shower curtain rod further includes the pressing member 6. A double-sided adhesive 61 is disposed on a bottom surface of the pressing member, and is matedly mounted in a groove 63 on the bottom surface of the pressing member 6. A positioning block 62 is disposed on the pressing member 6. Correspondingly, a positioning hole 15 for positioning and assembling the positioning block 62 is provided on the base 1. The positioning block 62 and the positioning hole 15 are respectively a non-circular block and a non-circular hole. For example, a rectangular block and a rectangular hole are used in this embodiment.

A through hole 51 is provided on the PVC gasket 5. Therefore, the positioning block 62 needs to pass through the through hole 51 and positioned and assembled in the positioning hole 15. The PVC gasket 5 is tightly mounted to the bottom surface of the base 1. That is, the base 1 is positioned and assembled on the positioning block 62 together with the PVC gasket 5 on the bottom surface. A counter bore 52 further requires to be provided on the bottom surface of the PVC gasket 5. The counter bore and the through hole are coaxial, so that the double-sided adhesive 61 on the bottom surface of the pressing member 6 and the PVC gasket 5 are on a same plane.

In addition, the positioning block 62 is inserted through the base 1 to be pressed against and in contact with a cambered surface of the front end of the sleeve 2. The specific structure is as follows. An outer cambered head 21 is disposed on the front end of the sleeve 2. When the front end of the sleeve 2 is radially swung relative to the base 1, the outer cambered head 21 is always pressed against and in contact with the positioning block 62.

An end of the outer tube 9 is directly connected to the base 1 by using a plug 94. The plug and the end of the outer tube 9 are mainly fixed by the screw inserted through a connecting hole 93. Moreover, the connection structure between the plug 94 and the base 1 is actually the same as that between the sleeve 2 and the base 1 in the inner tube 4. Therefore, details will not be described herein again.

According to the disclosure, the pressing member 6 is creatively added to the arcuate shower curtain rod. Therefore, during use, the pressing member 6 may be first accurately pasted on the mounting position of the wall surface by using the double-sided adhesive 61 on the bottom surface of the pressing member 6, thereby avoiding punching holes on the wall surface. Then the base 1 is positioned and assembled on the positioning block 62 of the pressing member 6 together with the PVC gasket 5 on the bottom surface. Mounting positions of two ends of the base 1 are predetermined by using the pressing member 6, thereby avoiding the trouble for incapability of determining the mounting position of the base and the requirement for continuous adjustment after the base 1 is pressed during the mounting of the traditional arcuate shower curtain rod.

In addition, the base 1 can also be in contact with the wall surface by means of the friction force between the PVC gaskets 5 and the adhesive force of the double-sided adhesive 61, so that the base 1 is mounted extremely firmly and stably and have a higher bearing strength.

In addition, the positioning block 62 of the pressing member 6 is inserted through the base 1 to be pressed against and in contact with the outer cambered head 21 of the front end of the sleeve 2. Therefore, even if the front end of the sleeve 2 is radially swung relative to the base 1 for fine adjustment, the front end of the sleeve is maintained to be in contact with and pressed against the pressing member 6 by using the outer cambered head 21, so that the pressing force on the base 1 does not weaken during the fine adjustment, thereby avoiding the injury caused by the accidental fall of the base 1 from the wall surface.

The foregoing descriptions are merely specific embodiments of the disclosure. A person skilled in the art should understand that any structure design similar to the embodiments shall fall within the protection scope of the disclosure.

What is claimed is:

1. A reinforced punch-free arcuate shower curtain rod, comprising:

a base, a sleeve, a short tube, an inner tube, an outer tube, and a pressing member;

wherein a front end of the sleeve is configured to connect with the base and swing in a radial direction, and a bottom of the base is configured to connect with a PVC gasket; and wherein a bottom surface of the pressing member is configured to paste on a wall surface by a double-sided adhesive, the pressing member further comprises a positioning block, wherein the base and the PVC gasket are configured to install on the positioning block, and the positioning block is configured to insert through the base and the PVC gasket and press against and in contact with a cambered surface of the front end of the sleeve.

2. The reinforced punch-free arcuate shower curtain rod according to claim 1, wherein the front end of the sleeve further comprises an outer cambered head, the front end of the sleeve is configured to swing in the radial direction relative to the base, and the outer cambered head is configured to press against and in contact with the positioning block.

3. The reinforced punch-free arcuate shower curtain rod according to claim 1, wherein the base further comprises a positioning hole for positioning and assembling the positioning block, and the positioning block and the positioning hole are configured as a non-circular block and a non-circular hole respectively.

4. The reinforced punch-free arcuate shower curtain rod according to claim 1, wherein the bottom surface of the pressing member further comprises a groove for mounting the double-sided adhesive.

5. The reinforced punch-free arcuate shower curtain rod according to claim 3, wherein the PVC gasket further comprises a through hole, the positioning block is configured to insert in the positioning hole through the through hole.

6. The reinforced punch-free arcuate shower curtain rod according to claim 1, wherein a front end of the short tube and a rear end of the sleeve are configured to connect coaxially and rotatably;

wherein the short tube further comprises a coaxially mounted screw rod, a screw sleeve threaded on the screw rod, and a retainer ring on a rear end of the screw rod;

wherein a rear end of the inner tube is configured to be telescopically sleeved in the outer tube, and a front end of the inner tube is configured to extend into a rear end of the short tube to connect with the screw sleeve; and the short tube is configured to drive the screw rod to rotate synchronously forward and backward, and to drive the screw sleeve and the inner tube to simultaneously move axially and telescopically along the screw rod.

7. The reinforced punch-free arcuate shower curtain rod according to claim 6, wherein the front end of the short tube further comprises a front sleeve, the rear end of the short tube comprises a rear sleeve, wherein a front end of the screw rod is configured to be inserted into and fixed to the front sleeve, and the front end of the inner tube is configured to be inserted through the rear sleeve into the rear end of the short tube.

8. The reinforced punch-free arcuate shower curtain rod according to claim 7, wherein the front sleeve comprises a non-circular hole formed along an axis, the front end of the screw rod comprises a non-circular shaft being inserted into the non-circular hole, wherein a screw is configured to thread in the non-circular hole to fasten the front sleeve and the screw rod.

9. The reinforced punch-free arcuate shower curtain rod according to claim 7, wherein a front end of the front sleeve comprises a ball head, an outer circumferential surface of the ball head comprises a ring rib, the rear end of the sleeve comprises a ball groove for assembling the ball head, and an inner circumferential surface of the ball groove comprises a ring groove; and wherein the ball head is configured to fit in the ring groove of the ball groove by the ring rib, and the sleeve is configured to connect with the short tube coaxially and rotatably.

10. The reinforced punch-free arcuate shower curtain rod according to claim 1, wherein an outer surface of the inner tube and an inner surface of the outer tube comprise a fastening groove and a fastening rib respectively for coupling with each other.

* * * * *